United States Patent [19]

Louboutin et al.

[11] Patent Number: 4,633,909

[45] Date of Patent: Jan. 6, 1987

[54] APPARATUS FOR THE RAPID IN-LINE MIXING OF TWO FLUIDS

[75] Inventors: Robert Louboutin, Crespieres; Vincent Savall, Velizy; Patrick Vion, Houilles, all of France

[73] Assignee: Degremont, Rueil Malmaison, France

[21] Appl. No.: 717,296

[22] Filed: Mar. 28, 1985

[30] Foreign Application Priority Data

Apr. 6, 1984 [FR] France ..... 84 05496

[51] Int. Cl.[4] ..... B01F 3/04

[52] U.S. Cl. ..... 137/888; 261/76; 261/DIG. 75; 366/174; 417/197; 417/198

[58] Field of Search ..... 366/174, 150; 137/888; 417/197, 198; 261/DIG. 75, 76

[56] References Cited

U.S. PATENT DOCUMENTS

| | | | |
|---|---|---|---|
| 2,058,309 | 10/1936 | Haering . | |
| 2,398,766 | 4/1946 | Bergesen | 417/197 |
| 2,602,398 | 7/1952 | Nittka | 417/197 |
| 3,143,401 | 8/1964 | Lambrecht | 261/76 |
| 3,376,023 | 4/1968 | Lage | 366/174 |
| 3,474,953 | 10/1969 | Duhaime et al. | 417/198 |
| 3,671,025 | 6/1972 | Elliott | 261/76 |
| 3,734,111 | 5/1973 | McClintock | 366/174 |

FOREIGN PATENT DOCUMENTS

| | | | |
|---|---|---|---|
| 9321 | 2/1907 | Denmark | 417/198 |
| 1557043 | 3/1970 | Fed. Rep. of Germany . | |
| 2027969 | 12/1970 | Fed. Rep. of Germany | 261/DIG. 75 |
| 2230185 | 1/1974 | Fed. Rep. of Germany . | |
| 1060468 | 4/1954 | France . | |
| 2056883 | 5/1971 | France | 261/DIG. 75 |
| 2385438 | 10/1978 | France . | |
| 260072 | 5/1970 | U.S.S.R. | 137/888 |

*Primary Examiner*—Tim Miles

*Attorney, Agent, or Firm*—Wenderoth, Lind & Ponack

[57] ABSTRACT

An apparatus for the rapid in-line mixing of an additive fluid with a primary fluid includes a conduit for passing therethrough in a direction of flow a primary fluid. A nozzle is positioned within the conduit and has an outlet. A pipe supplies an additive fluid to the nozzle, such that the additive fluid is injected through the outlet of the nozzle into the primary fluid. The nozzle has extending outwardly therefrom a member to cause the additive fluid to diffuse rapidly outwardly from the outlet in a generally radially oriented fluid current and thereby for mixing with the primary fluid within a zone occupying a limited length of the conduit, measured in the direction of flow from the outlet of the nozzle.

7 Claims, 4 Drawing Figures

APPARATUS FOR THE RAPID IN-LINE MIXING OF TWO FLUIDS

BACKGROUND OF THE INVENTION

The present invention relates to an apparatus for the rapid mixing of two fluids, particularly applicable to water treatment operations to effect the injection and "in-line" mixing of the water to be treated with reactants such as, for example, polymers, acids, bases, etc., or for carrying out more complex reactions such as coagulation.

In water treatment operations, it often is necessary to inject into the water to be treated and to mix therewith concentrated solutions of reactants, since the rate of flow of the reactants is less than the rate of flow of the water to be treated, often less than 1%.

A variety of equipment has been described in the past with which this type of in-line mixing is to be achieved, for example, injection tubes, baffle or fin systems, ejectors, etc. However, these different systems have various disadvantages. Thus, when using injection tubes or systems combining tubes and diaphragms, the blending or mixing is effected over conduits of very long length, for example lengths of from 3 to 100 times the diameter of the conduit conveying the water to be treated, this for a relatively poor degree of mixing. If fin, tube or lamella systems or an ejector are used, the quality of the mixture is good, but the mixing still takes place over a relatively long conduit length, of from 2 to 6 times the diameter of the conduit through which passes the water to be treated. Additionally, such systems result in relatively high friction or pressure losses ranging from 1 to 7 m of a column of water. Furthermore, none of the known systems permit two fluids to be mixed directly if the rate of flow of one of the fluids is much lower than the rate of flow of the other fluid, for example less than 0.01%.

SUMMARY OF THE INVENTION

With the above discussion in mind, it is an object of the present invention to provide an apparatus for the rapid in-line mixing of two fluids, i.e. an additive fluid with a primary fluid, whereby it is possible to overcome the above and other prior art disadvantages.

It is a further object of the present invention to provide an apparatus whereby it is possible at the same time to achieve an instantaneous and homogeneous mixing of concentrated solutions of reactants with water to be treated, wherein the reactants are injected at a lower rate of flow than that of the water to be treated.

It is an even further object of the present invention to provide such an apparatus operable at relatively low friction or pressure losses for a very large velocity gradient, the latter being defined as the square root of the quotient of the power dissipated in the fluid and of the product of the volume of the zone of mixing and the viscosity of the fluid.

These and other objects are achieved in accordance with the present invention by the provision of an apparatus for the rapid in-line mixing of an additive fluid with a primary fluid, the apparatus including a conduit for passing therethrough in a direction of flow a primary fluid, a nozzle positioned within the conduit and having an outlet, conduit means for supplying an additive fluid to the nozzle, such that the additive fluid is injected through the outlet of the nozzle into the primary fluid, and the nozzle having means for causing the additive fluid to diffuse rapidly outwardly from the outlet in a generally radially oriented fluid current and thereby for mixing with the primary fluid within a zone occupying a limited length of the conduit, measured in the direction of flow from the outlet. The diffusion causing means preferably is in the form of a member such as a diaphragm arranged and dimensioned to create at the outlet of the nozzle a radially oriented fluid current to enable the two fluids to be mixed rapidly in a very small space.

In a preferred arrangement of the present invention, the nozzle receives therein both the additive fluid and a fraction of the primary fluid, such that an initial mixing of the two fluids occurs within the nozzle. In an alternative arrangement, only the additive fluid is passed through the nozzle.

In accordance with the present invention, the diffusion causing means may be in the form of a ring extending outwardly from the nozzle and having an outer periphery spaced from the inner surface of the conduit through which passes the water to be treated. In an alternative arrangement, the diffusion causing means may be in the form of a plate extending outwardly from the nozzle to the conduit, the plate having therethrough orifices through which passes the primary fluid or water being treated.

BRIEF DESCRIPTION OF THE DRAWINGS

Other objects, features and advantages of the present invention will be apparent from the following detailed description of preferred embodiments thereof, given solely by way of nonlimiting example, and with reference to the accompanying drawings, wherein.

DETAILED DESCRIPTION OF THE INVENTION

Figure 1:
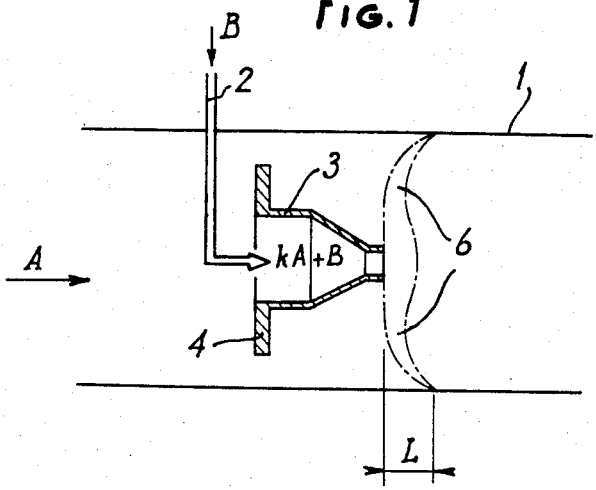
FIGS. 1 and 2 are schematic longitudinal cross sectional views of embodiments of the present invention.

In FIG. 1 is shown a conduit 1 having passing therethrough at a given rate of flow a primary fluid A, such as water to be treated. A secondary or additive fluid B is introduced by a conduit or pipe 2 into a nozzle 3 positioned within conduit 1, such that the additive fluid B is injected through an outlet of nozzle 3 into the primary fluid A.

Figure 3:
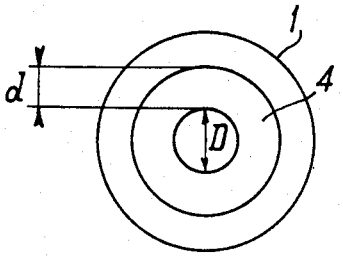
FIGS. 3 and 4 are schematic end or transverse cross sectional views illustrating dimensional relationships of embodiments of the apparatus of the present invention.

Extending generally radially outwardly from the exterior of nozzle 3, for example at the inlet end thereof, is a ring 4 which extends toward the conduit 1 and which is spaced therefrom to provide an annular clearance therebetween for the passage of the primary fluid A. As shown in FIG. 3, ring 4 has a size such that the radially outer edge thereof is spaced from the outer surface of nozzle 3 by a distance d which is equal to at least 0.3 times the diameter D of nozzle 3.

Figure 4:
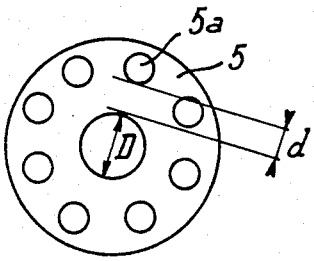

FIG. 4 illustrates a modification wherein the nozzle 3 has therearound a ring or plate 5 extending outwardly from the nozzle to the conduit 1. Plate 5 has therethrough orifices 5*a* through which passes the primary fluid A. Each orifice 5*a* has a radially inner edge spaced from the outer surface of nozzle 3 by a distance d equal to at least 0.3 times the diameter D of nozzle 3. This relationship occurs regardless of the shape and number of orifices 5*a*.

As shown in FIG. 1, nozzle 3 has an inlet end which is open to the flow of the primary fluid A, such that a fraction k of the primary fluid enters the inlet end of the nozzle and mixes within nozzle 3 with the additive fluid B supplied to the inlet by the pipe 2. In other words, the flow through the nozzle 3 is a mixture kA+B of a fraction k of primary fluid A and additive fluid B. This arrangement is advantageous when the rate of flow of fluid B is relatively small compared to the rate of flow of the fluid A, but is equal at least to 0.0005% of the rate of flow of fluid A. The nozzle 3 is dimensioned such that the fraction k is equal to from 1 to 15% of fluid A. The friction or pressure loss of the assembly will determine the relative rates of fluids A and B through the nozzle. Under these conditions, there is achieved a two stage mixing of the two fluids, the first stage being effected within nozzle 3 and the second stage being achieved at the outlet of the nozzle, in a manner to be discussed in more detail below.

Figure 2:
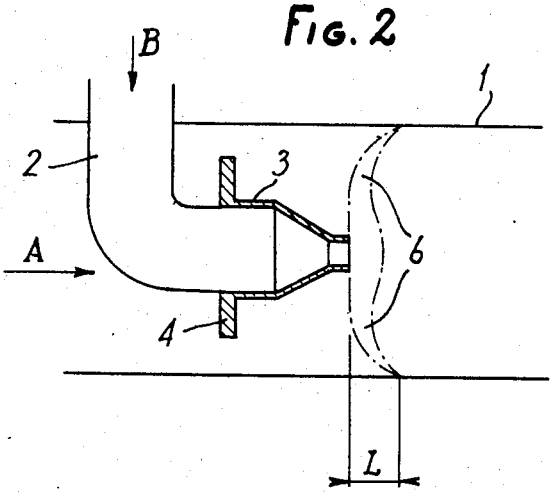

FIG. 2 illustrates a modified embodiment which is particularly advantageous when the rate of flow of fluid B is relatively high, for example, above 1% of the rate of flow of fluid A. In this embodiment, the nozzle 3 forms the end portion of pipe 2 for supplying fluid B, and the inlet end of nozzle 3 is closed to the fluid A. Accordingly, only fluid B is passed through nozzle 3.

In all embodiments of the invention, the provision of the ring 4 or plate 5 results in the creation around the nozzle 3, between the ring 4 or plate 5 and the end portion of the nozzle, a reduced pressure area which causes the fluid B or kA+B to diffuse rapidly outwardly from the outlet in a generally radially oriented fluid current 6. This causes the primary and additive fluids to rapidly mix within a zone occupying a limited length L of the conduit, measured in the direction of flow from the outlet of the nozzle. That is, the structure of the present invention sets up at the outlet of nozzle 3 a flat, generally cone-shaped current achieving virtually immediate and instantaneous diffusion outwardly of the fluid discharged from the outlet of the nozzle. The resultant rapid mixing occurs within length or distance L which is from only 10 to 20% of the diameter of conduit 1. Due to the structural arrangement of the present invention, this rapid radial diffusion of the fluid B of kA+B into the primary fluid A is independent of the form or element 4, 5, the overall friction or pressure loss of the system, and the rate of flow or flow velocity of the primary fluid A in conduit 1. Because of the speed at which the mixing is achieved, the mixing is accomplished with large velocity gradients at relatively low friction or pressure losses.

The following example illustrates the excellent results obtained by the apparatus of the present invention. Thus, an apparatus according to the invention was employed to mix a reactant B at a rate of flow of 75 l/h with a water current A flowing in conduit 1 having a diameter of 142 mm at a rate of flow of 50 to 150 $m^3/h$. The apparatus included a nozzle 3 with a diameter D of 54 mm, and provided with an element or diaphragm in the form of a ring 4, the distance d between the outer surface of the nozzle and the outer edge of the ring 4 being from 20 to 30 mm. Such arrangement resulted in mixing of reactant B in water A in 0.05 to 0.15 second over a conduit length L of 2 cm, with a friction or pressure loss of 0.20 to 5 mm and a velocity gradient (as defined above) at 20° C. of 4,000 $s^{-1}$ to 35,000 $s^{-1}$. Accordingly, the blending or mixing took place at a remarkably rapid speed over a very short conduit length with relatively low friction or pressure losses for a very large velocity gradient.

Although the present invention has been described and illustrated with respect to preferred features thereof, it is to be understood that various modifications and changes may be made to the specifically described and illustrated features without departing from the scope of the present invention. Particularly, it is apparent that one of ordinary skill in the art would know what fluids can be mixed in accordance with the present invention, and what flow rates would be contemplated for the two fluids.

We claim:

1. An apparatus for the rapid in-line mixing of an additive fluid with a primary fluid, said apparatus comprising:
   - a conduit for passing therethrough in a direction of flow a primary fluid;
   - a nozzle positioned within said conduit and having an outlet;
   - conduit means for supplying an additive fluid to said nozzle, such that the additive fluid is injected through said outlet into the primary fluid; and
   - said nozzle having means for causing the additive fluid to diffuse rapidly outwardly from said outlet in a generally radially oriented fluid current and thereby for mixing with the primary fluid within a zone occupying a limited length of said conduit, measured in said direction from said outlet, said means comprising a ring extending outwardly from a relatively large diameter upstream portion of said nozzle, said nozzle discharging said additive fluid from a relatively small diameter downstream portion of said nozzle, said nozzle portions being connected by an intermediate nozzle portion of decreasing diameter.

2. An apparatus as claimed in claim 1, wherein said nozzle has a diameter D, and said ring has an outer edge spaced from the outer surface of said nozzle by a distance d equal to at least 0.3D.

3. An apparatus as claimed in claim 1, wherein said ring comprises a plate extending outwardly from said nozzle toward said conduit, said plate having therethrough orifices through which passes the primary fluid.

4. An apparatus as claimed in claim 3, wherein said nozzle has a diameter D, and each said orifice has a radially inner edge spaced from the outer surface of said nozzle by a distance d equal to at least 0.3D.

5. An apparatus as claimed in claim 1, wherein said nozzle has an inlet, facing in a direction opposite to said direction of flow, open to the primary fluid, such that a fraction of the primary fluid enters said inlet and mixes within said nozzle with the additive fluid supplied to said inlet by said conduit means.

6. An apparatus as claimed in claim 1, wherein said conduit means comprises a pipe extending into an inlet end of said nozzle, said nozzle forms an outlet end of said pipe, and said inlet end of said nozzle is closed to the primary fluid, such that only the additive fluid is passed through said nozzle.

7. An apparatus as claimed in claim 1, wherein said limited length is from 10 to 20% of the diameter of said conduit.

* * * * *